US005934499A

United States Patent [19]

van der Hoven

[11] Patent Number: 5,934,499

[45] Date of Patent: Aug. 10, 1999

[54] LOCKER BOX

[76] Inventor: Clifton Aubrey van der Hoven, P.O. Box 7180, Blanco 6531, South Africa

[21] Appl. No.: 08/844,390

[22] Filed: Apr. 18, 1997

[51] Int. Cl.[6] ..... B65D 25/00

[52] U.S. Cl. ..... 220/475

[58] Field of Search ..... 220/475, 908, 220/3.2, 3.9; 270/475

[56] References Cited

U.S. PATENT DOCUMENTS 2,318,122 5/1943 Williams ..... 220/475
3,154,211 10/1964 Bobowski ..... 220/475 X
3,375,620 4/1968 Phillips ..... 220/475 X

*Primary Examiner*—Steven Pollard
*Attorney, Agent, or Firm*—Womble Carlyle Sandridge & Rice; Louis T. Isaf

[57] ABSTRACT

A locker box capable of being secured to a suitable support such as the pole of a beach umbrella or the like, the locker box being provided with at least two internal compartments at least partially defining between them a channel adapted to accommodate the support, a lockable lid and anchoring means capable of securing the locker box to the support and wherein, in use, the lid of the locker box is adapted to cover the anchoring means thereby preventing unauthorised removal of the locker box from the support.

12 Claims, 2 Drawing Sheets

LOCKER BOX

Applicant claims the benefit of the filing date of prior South African patent application Ser. No. 96/3117, filed Apr. 19, 1996, under 35 U.S.C. § 119.

TECHNICAL FIELD

This invention relate to a locker box suitable for use with an umbrella and more particularly a beach umbrella.

BACKGROUND OF THE INVENTION

Invariably people have to take valuables along when they visit the beach, for example, cash, a wrist watch, wallet, spectacles, sun glasses and, in today's world, also possibly their cellular phone. Once on the beach the safe storage of such valuables presents a problem. Safe lockers for storing such items are not always readily available and even if available may be some distance away and therefore inconvenient with the result that many people simply slip their valuables into their shoes or sandals or cover them with their beach towels, hoping that these items would not be stolen.

SUMMARY OF THE INVENTION

It is an object of this invention to provide a locker box for the storing of valuables such as cash, wrist watches, wallets, spectacles, sun glasses, cellular telephones, etc. It is a further object of this invention to provide a locker box for use with a beach umbrella.

According to this invention there is provided a box capable of being secured to a suitable support such as the pole of a beach umbrella or the like, the locker box being provided with at least two internal compartments at least partially defining between them a channel adapted to accommodate the support, a lockable lid and anchoring means cable of securing the locker box to the suppport and wherein, in use, the lid of the locker box is adapted to cover the anchoring means thereby preventing unauthorised removal of the locker box from the support.

According to a further feature of the invention the anchoring means comprises a pin adapted to pass through suitable apertures provided in the body of the locker box and the support.

A further feature of the invention provides for means to prevent lateral movement of the pin once installed.

A further feature provides for the means to prevent lateral movement of the pin once installed to comprise a protrusion provided on the inner surface of the lid which in its closed position, is adapted to abut the pin.

According to a further feature the aperture adapted to receive the pin are provided in the inward facing side panels of the internal compartments which define the channel adapted to accommodate the support.

A yet further feature of the invention provides for the anchoring means to comprise a collar and lock nut arrangement capable of being slidingly received by the support, the collar being provided with radially extending arms adapted to engage suitable slots provided in the body of the locker box.

According to a further feature the slots are provided in the inward facing side panels of the internal compartments which define the channel adapted to acommodate the support The invention also provides for a locker box capable of being secured to the pole of a beach umbrella wherein the anchoring means comprises an area within the locker box is adapted to accommodate the sliding release mechanism of the umbrella preventing access to the mechanism thus preventing the unauthorized folding down of the umbrella.

BRIEF DESCRIPTION OF THE DRAWINGS

This invention will now be described in more detail with reference to the accompanying drawings in which.

DETAILED DESCRIPTION

Figure 1:
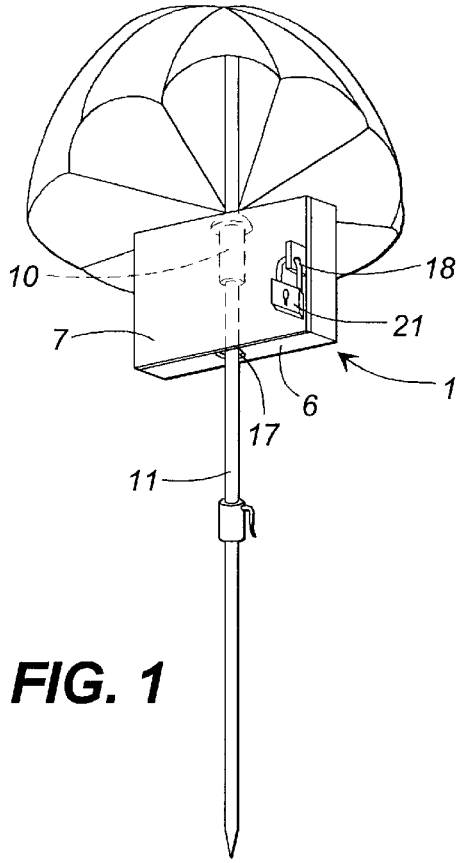
FIG. 1 is a perspective view, slightly from below, of a beach umbrella to which a locker box according to this invention is secured.

The locker box 1 comprises a back panel 2, side panels 3 and 4, top and bottom panels 5 and 6 and a lid 7 carried by hinges 8. The front edge of the top panel 5 is provided with a cut out section 9 large enough to fit over the upper extremity of the thicker section of the sliding release mechanism 10 carried by the umbrella pole 11 but it is not large enough to allow the locker box 1 to slide down over the sliding release mechanism 10.

Vertical panels 12, 13, 14 and 15 together with the back panel 2 and the closed lid 7 form a channel 16 capable of receiving the upright pole 11 as well as the lower narrower section of the sliding release mechanism 10. Whereas the cut out section 9 provided in the top panel 5 is large enough to fit over the upper extremity of the sliding release mechanism 10, the cut out section 17 provided in the front edge of the bottom panel 6 need only be large enough to accommodate the pole 11.

The side panel 4 is provided with a lip 18 capable of receiving a slot 19 provided in the lid 7. The lip 18 is provided with an aperture 20 for receiving a padlock 21 by means of which the lid 7 may be locked.

The locker box is further provided with shelves 22, 23 and 24. These shelves, in conjunction with the vertical panels 12, 13 and 14 create internal compartments within the locker box 1. These compartments are used for storing different sized articles. The distance between the shelves 22 and 23 and the top panel 5 provide an area within the locker box which is ale to accommodate the upper thicker section of the release sliding mechanism 10. This area thus acts as anchoring mean for the locker box 1.

In use the umbrella is first opened and supported in its upright position. The lid 7 of the locker box 1 is opened and the locker box 1 is placed over the umbrella pole 11 so that the upper thicker section of the release sliding mechanism 10 fits into the area between the shelves 22 and 23 and the top panel 5 while the narrower lower section of the sliding release mechanism 10 is accommodated between the vertical panels 12 and 14, the pole 11 itself being accommodated between the vertical panels 13 and 15 and the cut out section 17 provided in the bottom panel 6.

The locker box 1 is prevented from sliding down the pole 11 because the cut out section 9 is not sufficiently large to clear the upper thicker section of the sliding release mechanism 10.

Various articles to be stored are placed into the compartments within the locker box 1. The lid 7 is closed and locked by means of a suitable padlock 21. Once the lid 7 is closed and locked the sliding release mechanism 10 cannot be reached and since it cannot be release the locker box cannot be removed from the pole 11 or moved down the pole 11. It is therefore impossible to fold down the umbrella.

In order for a perpetrator to steal the contents of the locker box 1 has to physically brake open the locker box 1 or he has to carry away the open umbrella. Both actions would attract unwelcome attention with the result that the would be perpetrator would be seriously discouraged from tampering with the belongings of the owner.

Figure 2:
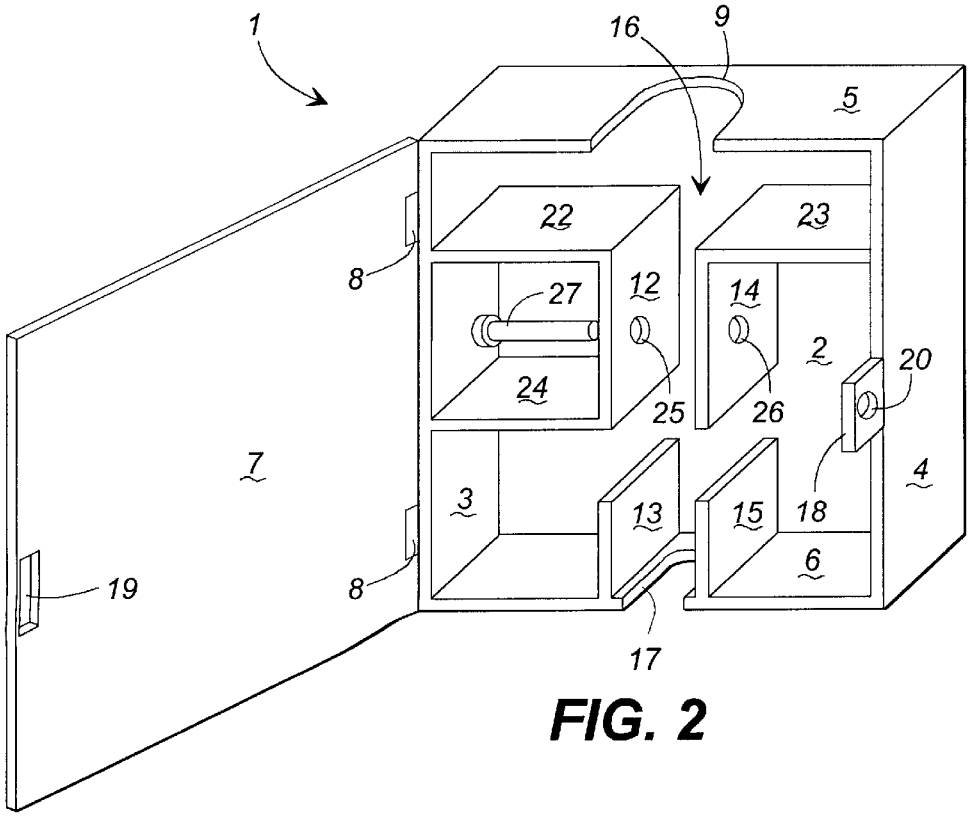
FIG. 2 is a perspective view of the locker box showing the lid in its open position.

FIG. 2 of the drawings also incorporates an alternative embodiment. In this embodiment the vertical panels 12 and 14 are provided with suitable opposing apertures 25 and 26. A suitable aperture is also provided in the umbrella pole 11. In use the aperture 25 and 26 ad the aperture in the pole 11 would be lined up and a suitable panel 27 passed through these apertures making it impossible to slide the locker box along the pole 11. Once the lid 7 is locked in place the pin 27 cannot be removed thus securing the locker box 1. The apertures 25 and 26 as well as in the pole 11 are located in such a position that once the locker box 1 is secured to the pole 11, the position of the locker box 1 prevents the sliding release mechanism 10 to be moved even though it might be possible to release same from the outside of the locker box 1. Once again, with the locker box locked into position, the umbrella cannot be folded down. The advantage of this embodiment is that the cut out section 9 in the top panel 5 need not necessarily be sufficiently large to fit over the upper extremity of the section of the sliding release mechanism 10, making the locker box 1 more universal in its application. Means for preventing the pin 27 from being dislodged while the lid 7 is locked in place may be provided. For example, the inner surface of the lid 7 may be provided with an inwardly extending protrusion (not shown) adapted, in the closed position of the lid 7, to abut the head of the pin 27 preventing lateral movement of the pin 27.

Figure 3:
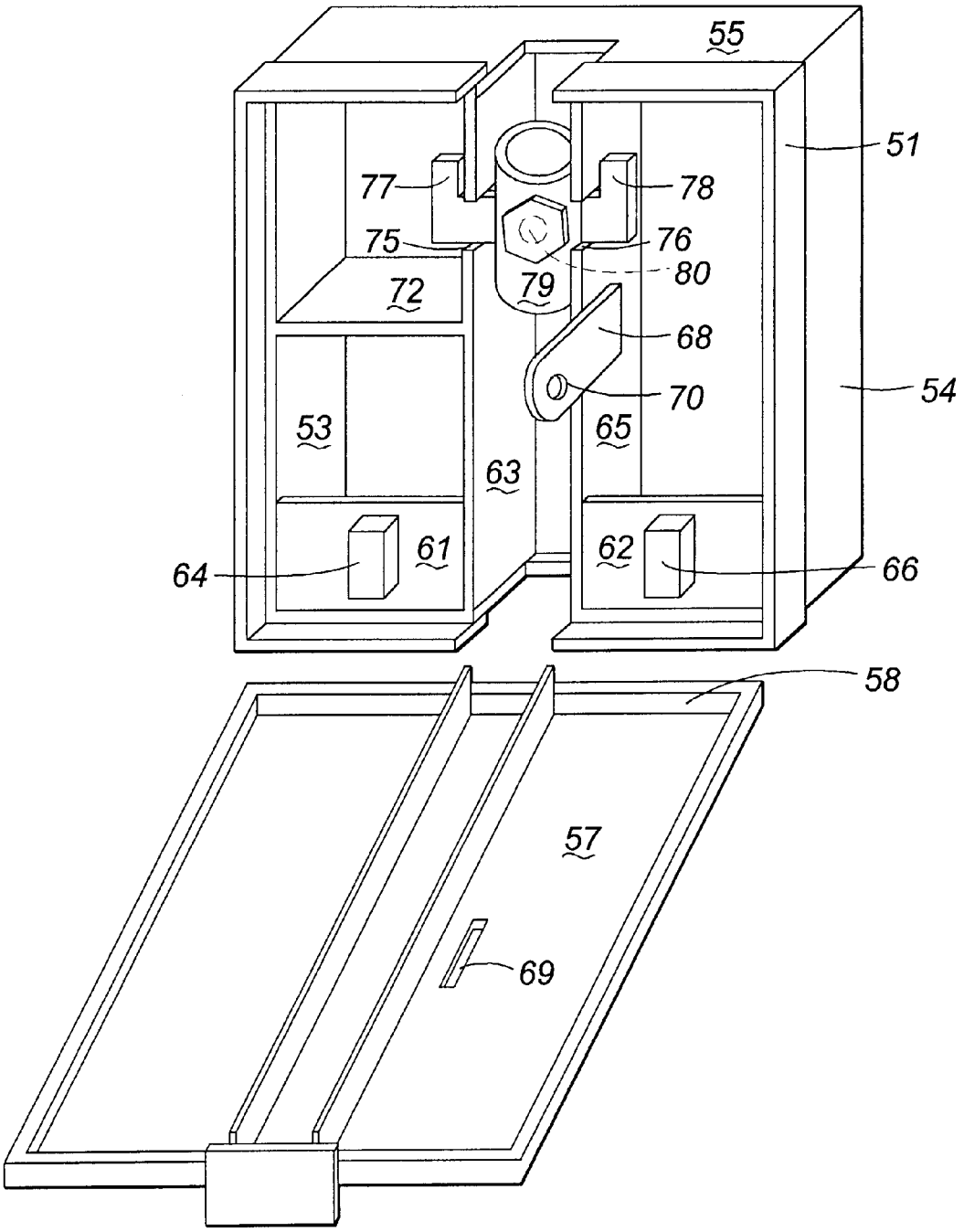
FIG. 3 is a perspective view of another embodiment of the invention.

A further alternative embodiment is illustrated in FIG. 3 of the drawings. In this particular embodiment the locker box may be provided with a frame section 51. The lid 57 is completely removable and includes an inwardly facing frame 58 section adapted to fit snugly within the frame section 51 of the locker box when the lid 57 is in its closed position. The lower front sections of the compartments flanked by the locker box side walls 53 and 54 and by the vertical panels 63 and 65 are provided with panels 61 and 62 which in turn are provided with stopper blocks 64 and 66. When the lid 57 is removed from its closed and locked position the lower part of the frame 58 may be inserted between the lower locker box frame section 51 and the stopper blocks 64 and 66 and in this position may act as tray or shelf onto which small articles may be placed.

The vertical panels 63 and 65 are provided with slots 75 and 76 capable of accommodating the arms 77 and 78 of anchoring means comprising a collar 79. The collar 79 is capable of being slightly received by the upper support pole 11 of the umbrella. The collar 79 is provided with a thumbscrew arrangement 80 which allows it to be secured to the pole 11.

The locker box is provided with a lip 68 having aperture 70 while the lid 57 is provided with a slot 69. When in the lid 57 is in its closed position the lip 68 protrudes through the slot 69. The aperture 70 is aperture to receive a standard padlock 21.

In use the umbrella, notably a beach umbrella is opened after which the collar 79 is slid form below over the upper pole 11. The pole 11 is then secured to the lower pole in the usual way and the umbrella is erected. The collar 79 is located about 100 mm below the sliding release mechanism 10 of the umbrella. In this position the collar 79 is locked in position by tightening the thumbscrew 80. Once so secured and with the lid 57 removed, the locker box 1 is placed in position by sliding the slots 75 and 76 over the arms 77 and 78 of the collar 79. By inserting the lower part of th frame 53 of the lid 57 between the lower locker box frame section 51 and the stopper blocks 64 and 66 the lid act as a tray or shelf onto which small articles may be placed.

The locker box 1 is prevented from sliding down the pole 11 by the collar 79 the arms 77 and 78 of which supports the locker box 1 by means of the slot 75 and 76 provided in the vertical panels 63 and 65. To lock the locker box the lid 57 is placed into position with the lip 68 protruding through the slot 69. A padlock 21 is used to lock the lid 57.

Once again, with the lid 57 locked, the collar 79 cannot be reached and because it cannot be released the umbrella cannot be folded down. The advantage of this is that it is not to pre-drill an aperture in the pole 11. A further advantage is that more than one locker box, one below the other, could be used at the same time. However, for additional security the pole 11 could in fact be pre-drilled and the screw forming part of the thumbscrew 80 could be passed through the aperture in which case it would be virtually impossible to move the collar 79 even with a great deal of force being applied to the outside of the locker box 1.

Further variations of the embodiments described may be possible without departing from the spirit and scope of the claims. For example, at a public swimming pool, physical training center or the like a number of fixed upright poles may be provided onto which each patron may secure his or her own security locker box in a manner similar to that described above. It is also feasible that with the necessary adaptations horizontal poles may be used. Alternatively the locker box may be suitably secured to some other surface, ie a wall of a wall by means of bolts. In this instance it would, of course, be a fixture to the wall.

This invention therefore provides for a suitable locker box for the string of valuables such as cash, wrist watches, wallets, spectacles, sun glasses, cellular telephones, etc.

I claim:

1. A locker box to be secured to a suitable support, such as a pole of a beach umbrella or the like, said locker box comprising:

a body;

at least two internal compartments having inward facing side panes and being arranged inside said body;

a channel extending through said body and shaped to accommodate the support, said channel being defined at least partially between said inward facing side panes of said at least two compartments;

an anchoring device arranged inside said body to secure said locker box to the support; and a lockable lid designed and arranged to cover said anchoring device to prevent unauthorized access to said anchoring device and thereby to prevent unauthorized removal of said locker box from the support.

2. The locker box of claim 1, wherein said anchoring device includes a pin adapted to pass through suitable apertures provided in said body of said locking box and in the support.

3. The locker box of claim 2, further comprising a device to prevent lateral movement of said pin extending through said apertures in said body of said locking box and in the support.

4. The locker box of claim 3, wherein said device to prevent lateral movement of said pin includes a protrusion provided on the inner surface of said lid which in its closed position, is adapted to abut said pin.

5. The locker box of claim 4, wherein said apertures adapted to receive said pin are provided in said inward facing side panes of said internal compartments which define said channel adapted to accommodate the support.

6. The locker box of claim 3, wherein said apertures adapted to receive said pin are provided in said inward facing side panes of said internal compartments which define said channel adapted to accommodate the support.

7. The locker box of claim 2, wherein said apertures adapted to receive said pin are provided in said inward facing side panes of said internal compartments which define said channel adapted to accommodate the support.

8. The locker box of claim 1, wherein said anchoring device includes a collar and lock nut designed and arranged to be slidingly received by the support, said collar being provided with radially extending arms adapted to engage suitable slots provided in said body of said locker box.

9. The locker box of claim 8, wherein said slots are provided in said inward facing side panes of said internal compartments which define said channel adapted to accommodate the support.

10. A locker box to be secured to a pole of a beach umbrella, said locker box comprising:

a body;

at least two internal compartments having inward facing side panes and being arranged inside said body;

a channel extending through said body and shaped to accommodate the pole, said channel being defined at least partially between said inward facing side panes of said at least two compartments;

an anchoring device arranged inside said body to prevent said locker box from movement along the pole, said anchoring device including an area within said locker box adapted to accommodate the sliding release mechanism of the umbrella; and a lockable lid designed and arranged to cover said anchoring device to prevent unauthorized access to said anchoring device and thereby to prevent unauthorized removal of said locker box from the pole.

11. A locker box to be secured to a suitable support, such as a pole of a beach umbrella or the like, said locker box comprising:

a body;

at least two internal compartments having inward facing side panes and being arranged inside said body;

a channel extending through said body and shaped to accommodate the support, said channel being defined at least partially between said inward facing side panes of said at least two compartments;

an anchoring device arranged inside said body to secure said locker box to the support, said anchoring device including a screw having an inner and an outer end and being designed and arranged to extend radially with respect to the support and with its inner end to be brought into frictional contact with the circumference of the support; and a lockable lid designed and arranged to cover said anchoring device to prevent unauthorized access to said anchoring device and thereby to prevent unauthorized removal of said locker box from the support.

12. A locker box secured to a pole of a beach umbrella, said locker box comprising:

a body;

at least two internal compartments having inward facing side panes and being arranged inside said body;

a channel extending through said body and shaped to accommodate said pole, said channel being defined at least partially between said inward facing side panels of said at least two compartments;

an anchoring device arranged inside said body to secure said locker box to said pole; and a lockable lid designed and arranged to cover said anchoring device to prevent unauthorized access to said anchoring device and thereby to prevent unauthorized removal of said locker box from said pole.

* * * * *